United States Patent [19]

Gorman et al.

[11] 4,230,268

[45] Oct. 28, 1980

[54] FORCED AIR FIREPLACE FURNACE

[76] Inventors: Ralph E. Gorman, R.R. 4, Siloam Springs, Ark. 72761; Robert W. Bruce, Rte. 4, Fairfield, Ill. 62837

[21] Appl. No.: 859,944

[22] Filed: Dec. 12, 1977

Related U.S. Application Data

[63] Continuation of Ser. No. 658,262, Feb. 17, 1976, abandoned.

[51] Int. Cl.[3] ..... F24B 7/00

[52] U.S. Cl. ..... 237/51; 126/110 R; 126/121

[58] Field of Search ..... 236/10, 11; 237/48, 237/51, 55, 53; 126/121, 122, 131, 110 R, 110 E; 98/40 D

[56] References Cited

U.S. PATENT DOCUMENTS

| | | | |
|---|---|---|---|
| 1,336,901 | 4/1920 | Handelan | 237/48 |
| 1,931,339 | 10/1933 | Zingone | 237/50 |
| 1,969,113 | 8/1934 | Baker | 126/110 R |
| 2,231,258 | 2/1941 | Elmore | 126/121 |
| 2,243,503 | 5/1941 | Frenette | 237/55 |
| 2,277,381 | 3/1942 | Black | 237/51 |
| 2,385,682 | 9/1945 | Burkholder | 236/11 |
| 2,619,022 | 11/1952 | Hergenrotler | 237/55 |
| 2,789,554 | 4/1957 | Dupler | 126/121 |
| 2,892,324 | 6/1959 | Quick | 165/16 |
| 3,126,154 | 3/1964 | Shoalts | 236/11 |
| 3,533,394 | 10/1970 | Rose | 126/121 |
| 3,888,231 | 6/1975 | Galluzzo et al. | 126/121 |
| 4,004,731 | 1/1977 | Zung | 126/121 |
| 4,010,728 | 3/1977 | Hempel et al. | 126/121 |
| 4,056,091 | 11/1977 | Moncrieff-Yeats | 126/121 |
| 4,082,322 | 4/1978 | Lever | 126/121 |

OTHER PUBLICATIONS

Electric Controls for Refrigeration and Air Conditioning, pp. 75–78 by B. C. Langley, copyright 1974.

*Primary Examiner*—Henry C. Yuen
*Attorney, Agent, or Firm*—Head & Johnson

[57] ABSTRACT

A heating system for buildings including a fireplace with an open front hearth for burning firewood, a chimney extending from the upper portion of the hearth, a metal firebox being open in the front and closed on the sides and back, a plenum chamber within and surrounding the sides and back of the metal firebox and the chimney lower portion, a horizontal heat distribution chamber positioned in the building attic and communicating at one end with the plenum chamber, an air distribution duct connected to the other end of the air distributing chamber, the duct extending to discharge heated air to a place in the building remote from the fireplace, a fan placed in the horizontal air distributing chamber, and a return air duct extending from a selected place in the building and communicating with the plenum chamber lower portion so that the fan draws air through the return air duct, through the plenum chamber around the firebox where the air is heated, through the horizontal distribution chamber, and out through the distribution duct for circulation of the heated air within the building.

1 Claim, 5 Drawing Figures

FORCED AIR FIREPLACE FURNACE

This is a continuation application of Ser. No. 658,262, filed Feb. 17, 1976, now abandoned.

BACKGROUND AND OBJECTS OF THE INVENTION

The earliest method of heating a building in America was the fireplace. To draw the smoke generated by the burning of the wood a draft must be constantly maintained in the chimney. Air drawn into the fireplace is expelled to the exterior of the building and none of the heat is circulated within the building itself, except for a small amount in the form of radiant energy.

Benjamin Franklin is credited with the concept of metal wood burning stoves. The fire in the Ben Franklin stove increased the radiation energy but nevertheless most of the heat of the burning wood is carried out the chimney to the exterior of the building.

After the advent of electricity forced air heating systems have been employed in which air is heated and distributed within the building so that the heat generated by the heating system is not entirely dependent upon only that which is radiated from the heat source. Today, the most common means of heating buildings and especially homes in the United States is the use of gas or oil fired furnaces with hot air being distributed by an electric motor operated fan. In the last few years the advent of the energy crisis has caused renewed interest in wood as a heating means. Fireplaces are becoming more popular but increase efficiency needs to be achieved so that a fireplace owner can gain economically from the use of wood as a heating fuel in addition to the aesthetic enjoyment of a wood burning fireplace.

The present invention is directed towards a heating system for a building and particularly a home, in which a fireplace can serve as the primary means of heating the home and in an arrangement wherein heat can be distributed from the fireplace to remote rooms.

It is therefore an object of this invention to provide an improved wood burning heating system for building.

More particularly, an object of this invention is to provide an improved heating system for buildings utilizing wood burned in an open hearth fireplace and including improved means of distributing heat generated by the burning wood to remote parts of the building.

These general objects as well as other and more specific objects of the invention will be fulfilled in the following description and claims, taken in conjunction with the attached drawings.

DESCRIPTION OF THE VIEWS

FIGS. 1 and 2 are illustrated as the invention would be employed in a building having a raised floor with a basement or crawl space beneath the floor to accommodate a return air duct.

SUMMARY OF THE INVENTION

A heating system for buildings and primarily for a home is described, the heating system being particularly adaptable for the use in firewood or like material as a fuel, the system including an open type hearth, a chimney extending from the upper portion of the hearth and communicating with the exterior of the building, a metal firebox liner positioned within the hearth, the firebox liner being opened at the front and closed on the sides and back and a plenum chamber within the hearth surrounding the sides and back of the metal firebox and the chimney lower portion, a horizontal air distributing chamber positioned in the building attic and having communication at one end with the plenum chamber, one or more air distributing ducts connected with the other end of the heat distributing chamber, the ducts extending to one or more locations in the building remote from the fireplace, an electrically driven fan positioned in the horizontal air distributing chamber, and a return air duct communicating with the plenum chamber lower portion so that when the fan is energized air is drawn through the return air duct up through the plenum chamber where it is heated by contact with the exterior surface of the metal firebox and distributed within the building. The heating system is described for use with a building having a raised floor with a crawl space or basement beneath the floor and in the alternative a building having a slab floor without means of accommodating a return air duct beneath the floor. A thermostat control system is described for operation of the air distributing fan.

DETAILED DESCRIPTION

Figure 1:
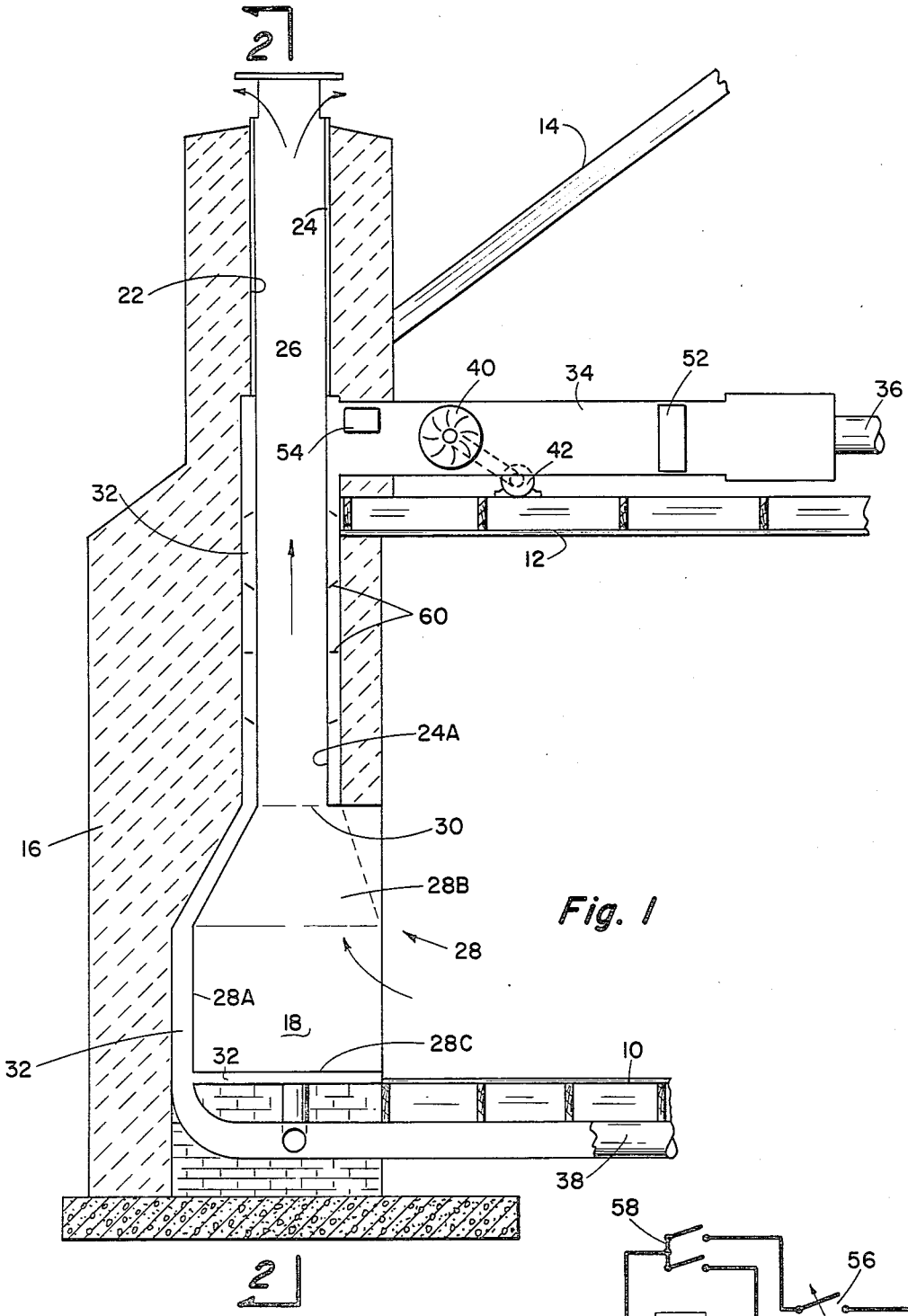
FIG. 1 is a cross-sectional view of a portion of a building having a fireplace and disclosing the improved means of providing for heat distribution from the fireplace to remote areas of the building.
Figure 2:
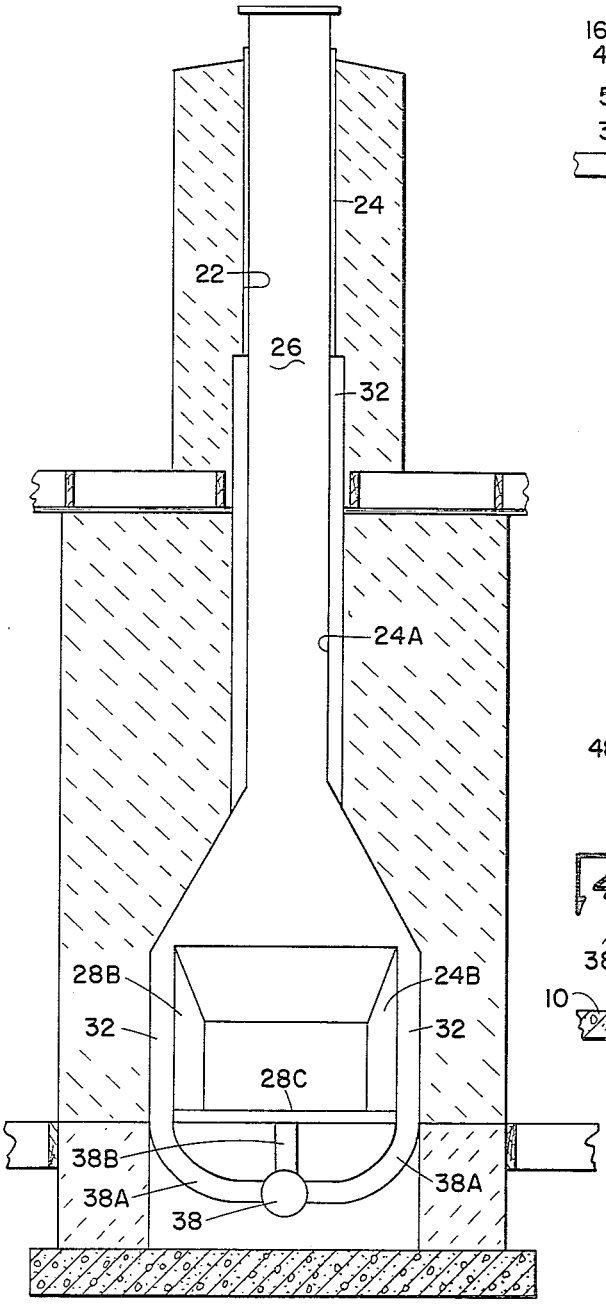
FIG. 2 is a cross-sectional view taken along line 2—2 of FIG. 1 and showing further details of the heating system of FIG. 1. Both

Referring to FIGS. 1 and 2 a heating system employing the invention is illustrated. The heating system is shown as utilized in a building shown in partial cross-section, the building having a floor 10, a ceiling 12 and a roof 14. The building includes a fireplace 16 usually of masonry construction. In these figures the fireplace is shown located at an exterior wall of the building, however, the principles of the invention are the same if the fireplace is located interiorly of the building.

The fireplace 16 has an open hearth 18 in which combustible material, such as firewood, coal or the like is burned. The fireplace 16 includes a chimney 22 having a flue liner 24 therein, the flue 26 extending upwardly to the exterior of the building.

Positioned in the hearth 18 is a metal firebox generally indicated by the numeral 28, the back of the firebox being designated 28A, the sides 28B and the bottom 28C. The firebox is open in the front and the upper end at 30 communicates with the lower end of flue liner 24.

Surrounding the firebox is a plenum chamber 32. The plenum chamber may extend only on the back and sides or preferably on the back, sides and bottom of the firebox. In addition, the plenum chamber 32 extends upwardly to encompass the lower portion of flue 26. The lower portion of the flue liner 24A is preferably of metal. The flue liner 24 above the plenum chamber 32 may be of metal or may be of ceramic material as is customarily used in a chimney or fireplace.

Positioned in the attic of the building, that is, the space above the ceiling 12 and below roof 14, is a horizontal air distributing chamber 34. The first end of distributing chamber 34 communicates with the interior of plenum chamber 32. The other end of the plenum chamber 34 receives one or more distribution ducts 36. In the typical installation a plurality of distribution ducts 36 will connect to the horizontal air distributing chamber 34, the ducts 36 extending to various rooms in the building so that heat can be equally distributed throughout the building.

Positioned beneath floor 10 is a return air duct 38 having one end in communication with plenum chamber 32. As shown in FIG. 2, the return air duct 38 may branch at the inner end providing portions 38A which extend out to connect with the plenum chamber portions formed exteriorly of the sides 28B of the firebox. In addition, a short extension 38B of the return duct may extend upwardly and communicate with the plenum chamber portion formed below the floor 28C of the firebox.

The return air duct 38 may extend to a central place in the building for taking in air to be heated and recirculated or in the preferred arrangement, the return air duct 38 is branched to gather air from various places in the building so as to cause a more even heat distribution.

With a fire in the hearth 18 the walls of the firebox, including the back, sides and bottom, become heated, as well as the lower portion 24A of the flue liner. Air drawn through the return air duct passes upwardly in the plenum chamber 32 surrounding the firebox and lower portion of the flue liner and is heated.

A fan 40 is located in horizontal air distributing chamber 34, the fan being driven by a motor 42. The motor may be mounted either within the chamber 34 or external to it. With the fan 40 in operation air is moved in the plenum chamber around the firebox to gather a substantial portion of the heat of the burning material in the hearth 18 for distribution in the building. In addition, the burning material heats the area of the building immediately in front of the fireplace by radiation as does a typical fireplace, however, by the use of this invention areas of the building remote from the fireplace are benefited from the heat of fuel burned in the fireplace.

Figure 4:
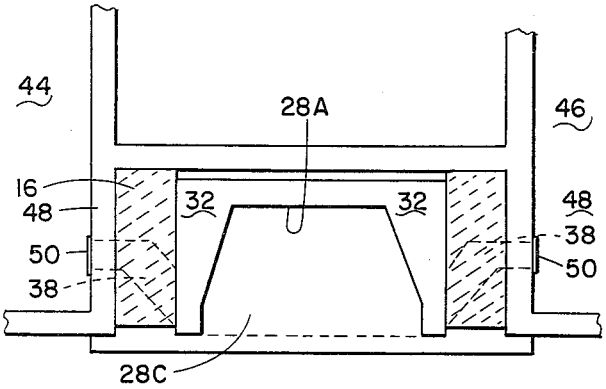
FIG. 4 is a cross-sectional view taken along line 4—4 of FIG. 3 showing more details of the arrangement wherein there are no facilities for placing a return air duct below the floor of the building.
Figure 3:
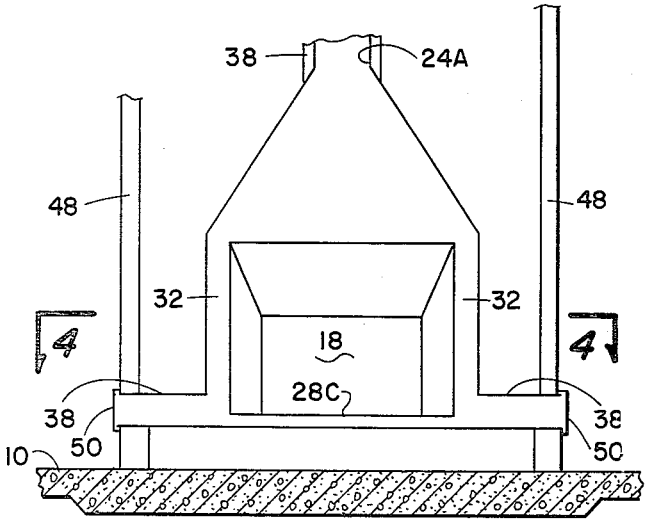
FIG. 3 is an elevational cross-sectional view of the lower portion of the heating system of this invention showing an arrangement which may be employed when the fireplace is constructed in a building having a slab floor, that is, without a crawl space or basement beneath the floor.

The arrangement of FIGS. 1 and 2 shows the return air duct 38 as being positioned beneath the floor 10 as is convenient in a building having a raised floor with a basement or crawl space beneath it. This same arrangement can be utilized in a building constructed with a slab floor provided the return air duct 38, including all branches which form a part of it is placed in position before the slab floor is poured. FIGS. 3 and 4 show an arrangement wherein the heating system of this invention may be installed in a building having an existing slab floor which does not permit easy installation of a return air duct. In this arrangement the fireplace is built with a raised hearth, that is, with the bottom of the firebox 28C spaced above floor 10. The return air is gathered in return air duct 38 which extends away from the firebox and generally horizontally with the floor. FIGS. 3 and 4 show the fireplace 16 mounted interiorly of a building having rooms 44 and 46 spaced at either side of the fireplace and separated from the fireplace by walls 48. The return air duct is in two parts extending to either side of the firebox and through registers 50 with the interior of rooms 44 and 46. In this way even though the fireplace is installed over a slab floor air can be recirculated from other parts of the building into the plenum chamber. In is advantageous to have the return air duct 38 arranged so as to withdraw the air from a place spaced away from the fireplace so that air heated by radiation from the fireplace is not drawn into the plenum chamber.

As shown in FIG. 1 is a supplemental heating means 52 may be positioned within the horizontal air distributing chamber 34. The supplemental heating means 52 may be in the form such as an electric resistance heater. Element 52 may be in the form of coils of a reverse cycle electrically operated heat pump so that heat may be supplied in colder seasons as a supplement to the heat generated in the fireplace and in hot weather element 52 may be used to cool the interior of the building. Obviously, the element 52 may serve only as an air conditioning unit if desired so that the heating system may be utilized to air condition the drilling in the warm temperatures in which case no heat would be applied in the hearth 18.

A thermostat may be mounted in the building for controlling motor 42 to drive fan 40 when heat is required. In the ideal operation of the fan 40 it will be desirable that it be energized to supply heat only if the temperature of air within plenum chamber 32 is greater than that in the building itself since otherwise the fan 40 would serve only to recirculate the air without raising the temperature in the building. For this reason a heat actuated switch 54 may be positioned within or adjacent the plenum chamber 32 so that when the temperature of the air in the plenum chamber is above a preselected level, such as 80°, switch 54 will be closed. With the switch in series with a thermostat and motor 42, the thermostat can be used to automatically energize the motor 42 as required to move air through the plenum chamber and into the interior of the building when required to heat the building and to terminate the movement of air when the heat reaches the preselected level.

Figure 5:
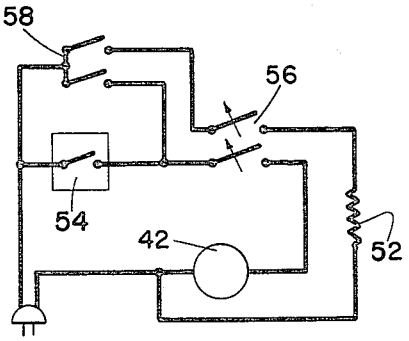
FIG. 5 is a wiring diagram showing one arrangement using a thermostat to control the heating system.

When a supplemental heating element 52 is employed a circuit arrangement shown in FIG. 5 may be used. A double pole thermostat 56 is utilized as well as a double pole supplemental heat switch 58. With the heat switch 58 open no voltage is applied to supplemental heater 52 and motor 42 will be energized only if the heat actuated switch 54 is closed, indicating warm air in the plenum chamber 32 and if the thermostat 56 is closed indicating a demand for increased temperature in the building. When either switch 54 or 56 is open motor 42 will not be energized. When supplemental heat switch 58 is closed and if thermostat switch 56 closes in response to lower temperature in the building motor 52 is energized along with the electric heater element 52.

The circuit arrangement of FIG. 5 is merely exemplary of various control circuits which may be employed with the heating system of this invention so that a building may be heated by two different sources of heat. Many home owners prefer to burn a fireplace in the evening when it can be enjoyed by the family but do not have time to maintain a fire in the fireplace through the night and in the working part of the day. When the fireplace is being used, the heat generated in it can be efficiently distributed throughout the whole house to substantially reduce fuel costs.

Normally the flue 26 is closed by a damper. Various kinds of dampers are available and none are illustrated herein since they are well known in the art. Electrically or mechanically operated dampers are available and it can be seen that such may be applied to the fireplace disclosed herein without changing the concept in any way.

To increase the effectiveness of the heating system baffles 60 may be positioned in plenum chamber 32. The function of baffles 60 is to cause the air flowing through the plenum chamber to take circuitous and more turbulent paths for more heat transfer contact with the firebox and flue liner walls.

While the invention has been described with a certain degree of particularity it is manifest that many changes may be made in the details of construction and the arrangement of components. It is understood that the invention is not to be limited to the specific embodiments set forth herein by way of exemplifying the invention, but the invention is to be limited only by the scope of the attached claim or claims, including the full range of equivalency to which each element or step thereof is entitled.

What is claimed:

1. A heating system for a building having a floor, a roof, a horizontal ceiling below the roof, and an attic between the ceiling and the roof comprising:

a fireplace supported on the floor having a hearth open in front;

a vertical chimney extending from the upper portion of the hearth, passing through the building ceiling and attic and communicating with the building exterior and terminating above the building roof;

a metal firebox positioned in the hearth in spaced relation therewith, the firebox being open in the front and closed on the sides, the back and bottom, and having an opening in the top;

a hearth plenum chamber formed by the spaced relation of said hearth and said metal firebox, the plenum chamber surrounding the sides, back and top of said metal firebox;

a vertical flue liner of heat conducting metal within said chimney affixed at its lower end to said opening in the top of said metal firebox, the flue liner being of sufficient height to pass through the building ceiling and at least prt way through the building attic, the upper end of the flue liner communicating with the upper end of said chimney whereby smoke produced by combustion of consumable fuel in said firebox is conducted to the exterior of the building, the exterior dimensions of the flue liner being less than the interior dimensions of said chimney providing a vertical chimney plenum chamber, the lower end of the chimney plenum chamber communicating with the upper end of the hearth plenum chamber, the chimney plenum chamber extending at least partially within the building attic;

an elongated horizontal forced air heat distributing chamber positioned in the building attic above the ceiling and below the roof and having communication within the attic at one end with said vertical chimney plenum chamber;

a plurality of air distribution ducts connected to the other end of said heat distributing chamber for conducting air to selected places of discharge in the building;

a motor driven fan positioned in said horizontal forced air heat distributing chamber;

at least one return air duct extending from a selected place in the building and communicating with the lower portion of said hearth plenum chamber whereby return air from said selected place is recycled to the hearth plenum chamber;

said plenum chamber includes a portion below the bottom of said hearth firebox and said return air duct extends horizontally below the building floor and communicates upwardly with the lower portion of said hearth plenum chamber whereby said fan, when energized, draws air from said return duct through said hearth plenum chamber and circulates heated air through said chimney plenum chamber and thence through said forced air heat distributing chamber, and through said air distribution ducts to distribute heat from fire in said hearth to the interior of the building.

* * * * *